US011103092B2

(12) United States Patent
Connor

(10) Patent No.: US 11,103,092 B2
(45) Date of Patent: Aug. 31, 2021

(54) CABINET FOR NON-REVERSING IMAGE MIRROR

(71) Applicant: Michael D Connor, Bernville, PA (US)

(72) Inventor: Michael D Connor, Bernville, PA (US)

( * ) Notice: Subject to any disclaimer, the term of this patent is extended or adjusted under 35 U.S.C. 154(b) by 243 days.

(21) Appl. No.: 16/510,152

(22) Filed: Jul. 12, 2019

(65) Prior Publication Data

US 2020/0015607 A1 Jan. 16, 2020

Related U.S. Application Data

(60) Provisional application No. 62/697,806, filed on Jul. 13, 2018.

(51) Int. Cl.
*A47G 1/04* (2006.01)
*A47B 67/00* (2006.01)

(52) U.S. Cl.
CPC ..... *A47G 1/04* (2013.01); *A47B 67/005* (2013.01)

(58) Field of Classification Search
CPC ..... A47B 67/005; A47G 1/04
USPC ..... 312/224, 225, 226, 227; 359/872
See application file for complete search history.

(56) References Cited

U.S. PATENT DOCUMENTS 1,966,800 A * 7/1934 Katzman ..... A47B 67/005 312/225
1,991,054 A 2/1935 Hampke
2,678,252 A * 5/1954 Swearingen ..... A47G 1/04 312/223.5
3,909,091 A * 9/1975 Tantillo ..... E05D 7/081 312/224
4,235,524 A 11/1980 Lechter et al.
4,268,121 A 5/1981 Peskin
4,580,880 A 4/1986 Watson
4,720,184 A 1/1988 Watson
4,884,176 A * 11/1989 Palka ..... A47B 67/005 362/135
5,357,377 A 10/1994 Payne, Jr. et al.
5,430,578 A 7/1995 Reagan
5,521,744 A 5/1996 Mazurek
5,625,501 A 4/1997 Taggert
6,293,681 B1 9/2001 Frank
6,322,222 B1 11/2001 Kobayashi
2009/0052072 A1 2/2009 Egosi
2010/0128374 A1 5/2010 Zaglin et al.

FOREIGN PATENT DOCUMENTS

KR 101620546 B1 5/2016
WO 96/30785 10/1996
WO 2010/130859 A1 11/2010

* cited by examiner

*Primary Examiner* — James O Hansen
(74) *Attorney, Agent, or Firm* — Volpe Koenig

(57) ABSTRACT

A cabinet for a non-reversing image mirror ("NRIM") is provided. A pivot assembly is provided for deploying the NRIM in open and closed positions. A second front-surface mirror of the NRIM has a width greater than a first front-surface mirror thereof. The cabinet may have additional compartments and/or second-surface mirror(s).

21 Claims, 7 Drawing Sheets

CABINET FOR NON-REVERSING IMAGE MIRROR

FIELD OF INVENTION

The subject matter of the present application pertains to the field of non-reversing image mirrors. It is particularly related to a non-reversing image mirror mounted within a cabinet or similar structure and rotatable between an open/viewing state and a non-viewing state.

BACKGROUND

A non-reversing image mirror (referred to hereinafter as "NRIM"), also commonly referred to as a non-reversing mirror, is used to orient a reflected image in the same manner that it is viewed by others. In other words, for a person using such a mirror, the reflected image is not flipped in the sagittal plane. Two mirror panels are placed orthogonally to each other to form the NRIM while the viewer faces the intersection of the mirror panels. The two mirror panels both extend at about 45 degree angles relative to a viewer. Therefore, a NRIM takes up more space than a typical flat mirror (usually provided as a second-surface mirror). This additional space may be undesirable at times when not in use, for example when in a small room. Likewise, aesthetically, the additional space of a NRIM may be considered inelegant or not streamlined. However, if a NRIM were fully recessed within a wall or cabinet, it would be difficult to view and access and would be susceptible to poor lighting.

Superior reflected images are produced by NRIM assemblies. However, there is not an easy, convenient way to view oneself in a conventional flat panel reverse image mirror and then simply and quickly switching to a non-reversing image system. With this disclosure, alternating between both mirror systems is as effortless as opening and closing a medicine cabinet door.

Additionally, this disclosure greatly improves the issues of considerable depth and substantial bulkiness associated with static NRIM assemblies by incorporating unequal width mirror panels that smoothly rotate about a strategically located pivot point, thus situating the non-reversing image mirror system in the center of the cabinet enclosure and displaying the non-reversed image significantly closer to the user. The distance between the intersection of the mirror panels and the front opening of the cabinet is consequently reduced relative to the distance found in static models.

The rotating mirror system of the present disclosure is secured and contained within a cabinet that is easily surface mounted on a wall or partition or alternatively in a semi-recessed or fully-recessed installation at the preferred eye level of the user. The cabinet may also be placed on appropriate horizontal surfaces. In both vertical and horizontal placements, the cabinet may be inverted to better serve right-handed or left-handed viewers.

Furthermore, the individual mirror panels of the non-reversing image assembly are fixed within their corresponding frames. The placement of adjustment components allows the user to easily and conveniently readjust the mirror assembly as may become necessary. Both mirror panels incorporate safety films and coatings to protect users and the reflective coatings of the first-surface mirrors.

When combined with a variety of adjoining storage component options, this Cabinet is a practical and improved alternative to standard wall-mounted residential style medicine cabinets with mirrored doors as well as countertop and vanity arrangements. Separately, this Cabinet system can serve medical professions such as physicians, plastic surgeons, dermatologists, optometrists and ophthalmologists, dentists and orthodontists. Other commercial enterprises that use mirrors, for instance, jewelers, boutiques, hair salons and barber shops, cosmetic sales counters, hotels, restaurants and apartments benefit from the ability to substitute advertising, artwork, smart mirrors, electronic displays, logos, trademarks and photographs on the outside flat panel in order to promote their products and services.

A NRIM may be more likely to be accidentally damaged or sullied due to its shape and/or construction. A NRIM may be formed of a first-surface mirror, that is, a mirror with the reflective surface being above a backing, as opposed to the conventional, second-surface mirror with the reflective surface behind a transparent substrate (such as glass or acrylic). A first-surface mirror can produce a clearer and more precise reflected image than a second-surface mirror. However, due to the lack of transparent substrate, first-surface mirrors may be more susceptible to damage from abrasion than typical second-surface mirrors.

The present disclosure is directed to overcoming one or more problems of the prior art, such as bulk, aesthetics, and lack of storage. Additionally, the present disclosure is directed to a convenient manner of use and access to a NRIM.

SUMMARY

In one aspect, the present disclosure is directed to a mirror cabinet having a NRIM pivotably disposed within a cabinet. The NRIM includes a first front-surface mirror, a second front-surface mirror, and a pivot. The first front-surface mirror is connected to the second front-surface mirror. The second front-surface mirror is disposed at an angle of about 90 degrees to the first front-surface mirror to create a non-reversing image viewing plane. The pivot is attached to the second front-surface mirror between a first side wall and a second side wall of the second front-surface mirror. The second front-surface mirror has a width greater than a width of the first front-surface mirror. The cabinet includes a front opening and a pivot counterpart. The pivot is connected to the pivot counterpart such that the NRIM is pivotable between a closed position and an open position. A back side of the second front-surface mirror substantially covers the front opening in the closed position. The non-reversing image viewing plane is visible through the front opening in the open position.

BRIEF DESCRIPTION OF THE DRAWINGS

The foregoing summary and the following detailed description will be better understood when read in conjunction with the appended drawings, which illustrate a preferred embodiment of the invention. In the drawings.

DETAILED DESCRIPTION OF THE PREFERRED EMBODIMENT(S)

Figure 1:
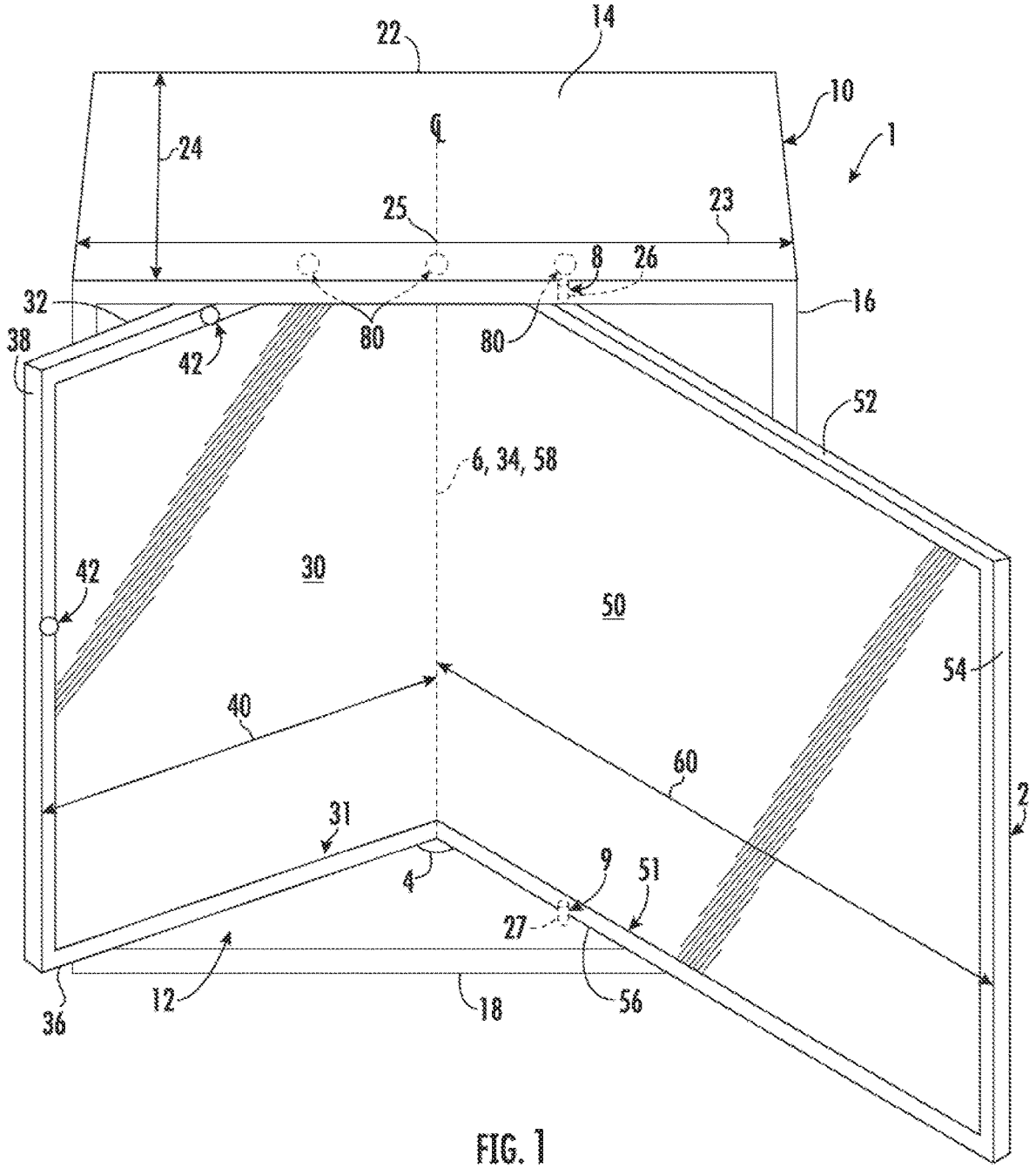
FIG. 1 is a front perspective view of a cabinet assembly according to an embodiment of the present invention in an open position.

Certain terminology is used in the following description for convenience only and is not considered limiting. Words such as "front", "back", "top" and "bottom" designate directions in the drawings to which reference is made. This terminology includes the words specifically noted above, derivatives thereof and similar words. Additionally, the terms "a" and "one" are defined as including one or more of the referenced item unless specifically noted. The phrase "at least one" followed by a list of two or more items (such as A, B, or C) means any individual one of A, B or C as well as any combination thereof. The term "substantially" means within ±5% of a given value or ±5 degrees from a given angle, as appropriate. The terms "about" and "generally" mean within ±10% of a given value or ±10 degrees from a given angle, as appropriate.

At the outset, it is understood that this invention is not limited only to the particular embodiments, methodology, materials, and modifications described herein, and as such may vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the following example methods, devices, and materials are now described.

Figure 2:
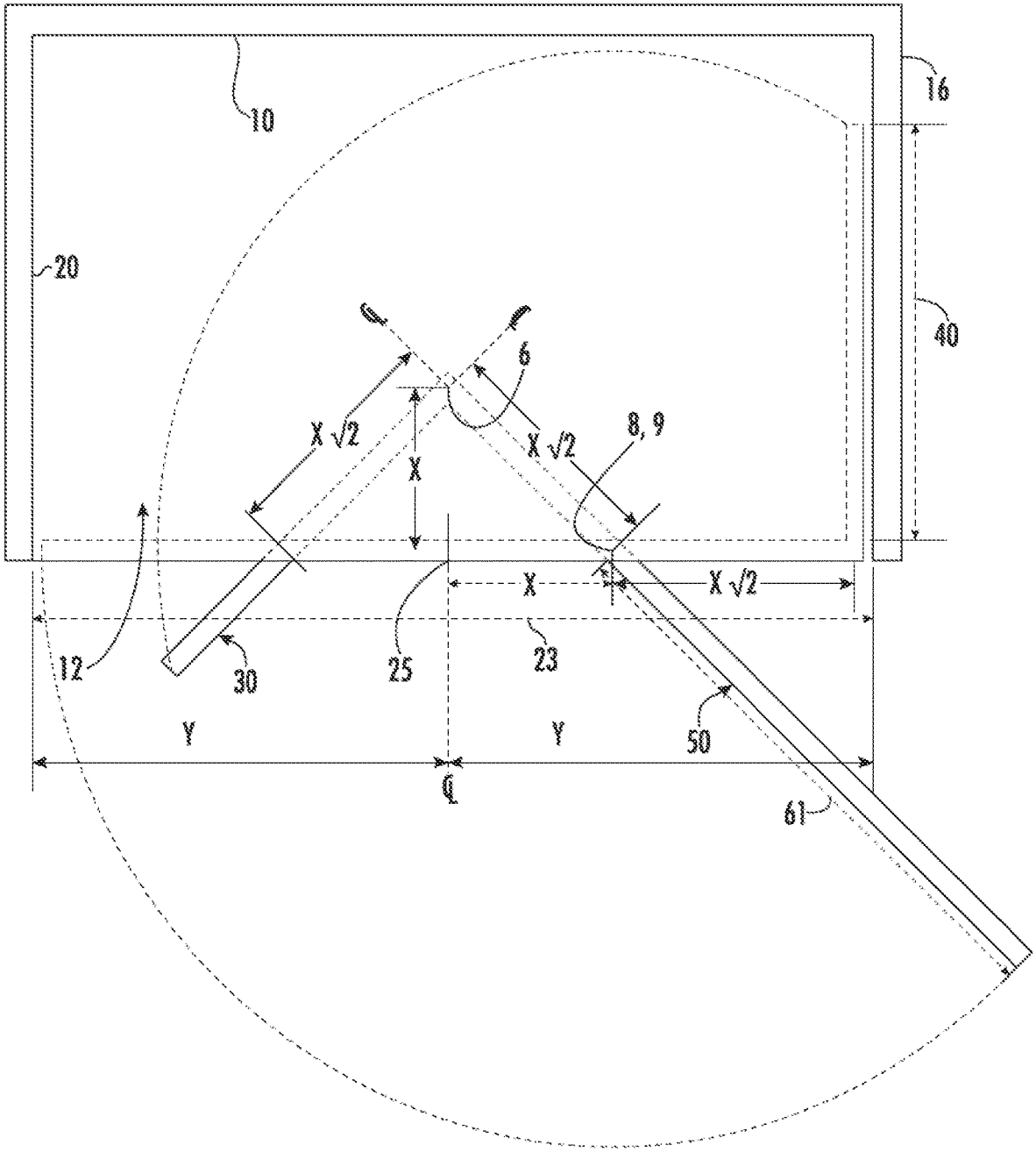
FIG. 2 is a top plan view of the cabinet assembly of FIG. 1.

FIGS. 1-2 show an exemplary embodiment of a mirror cabinet system 1 including a NRIM 2 mounted in a cabinet 10.

The NRIM 2 is formed of a first front-surface mirror 30 and a second front-surface mirror 50 disposed at an angle 4 and intersecting at an intersection 6 with a T-shape, that is, one of the first or second front-surface mirrors 30, 50 extends beyond the front surface of the other of the front-surface mirrors. Other types of mirrors are applicable, but front-surface mirrors produce the projected non-reversed viewing plane or image while minimizing or eliminating the appearance of a vertical line between the mirrors. The angle 4 is fixed at least at generally 90 degrees to produce a non-reversed image. In some embodiments, the angle 4 is exactly 90 degrees.

In the illustrated embodiments, the intersection 6 has the first and second front-surface mirrors 30, 50 in contact in a T-shape, although in other embodiments they may meet and mutually terminate with an L-shape, be slightly spaced apart, or have an intervening pad, such as a rubber strip or elastomeric coating. The spaced-apart placement or intervening pad may be on a microscopic scale, so as to not affect the non-reversed viewing plane or image. In other embodiments, the first and second front-surface mirrors 30, 50 may be formed from one continuous flexible reflective surface, with the intersection 6 replaced with a rounded corner.

Figure 3:
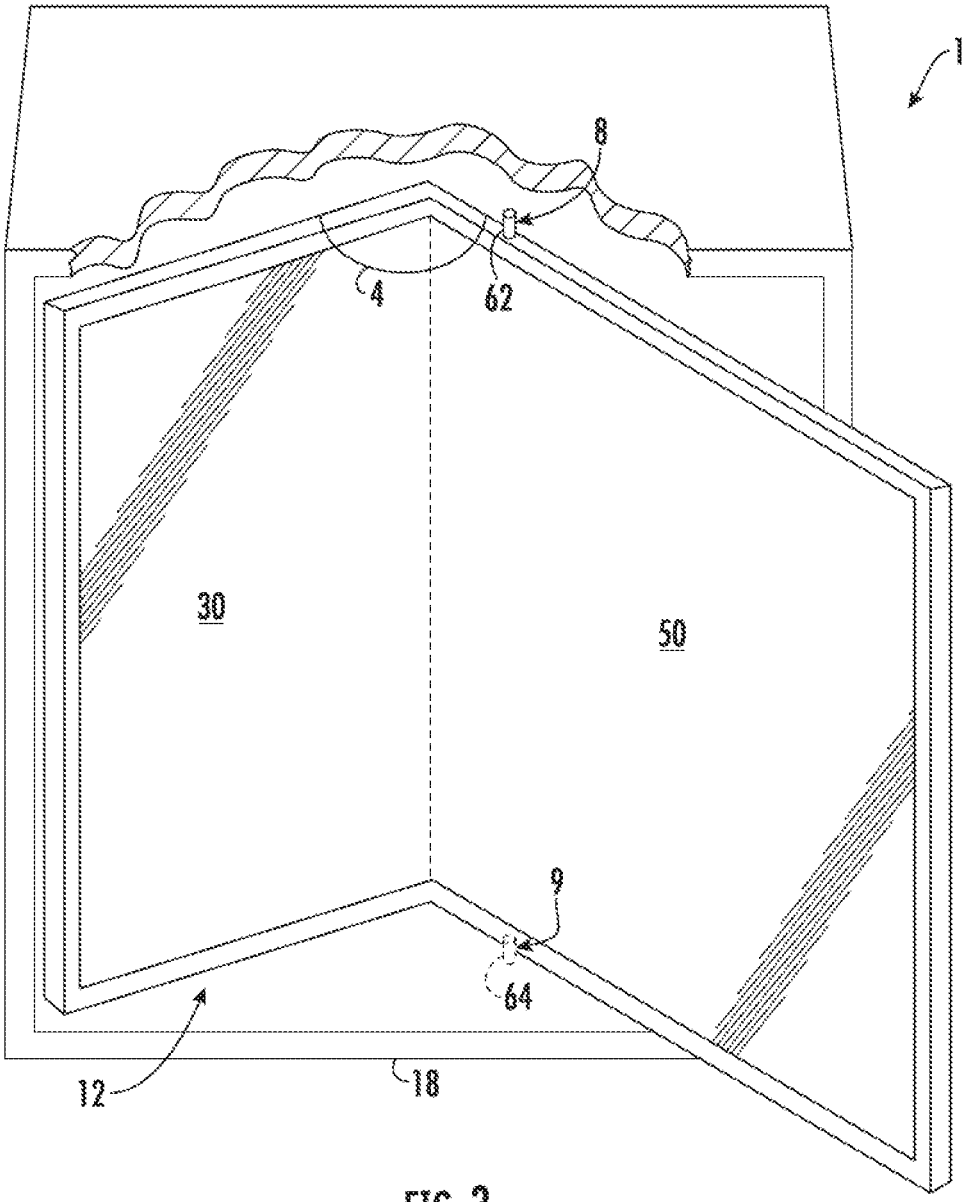
FIG. 3 is a front perspective view of a cabinet assembly according to another embodiment of the present invention in an open position with a portion cut away.
Figure 4:
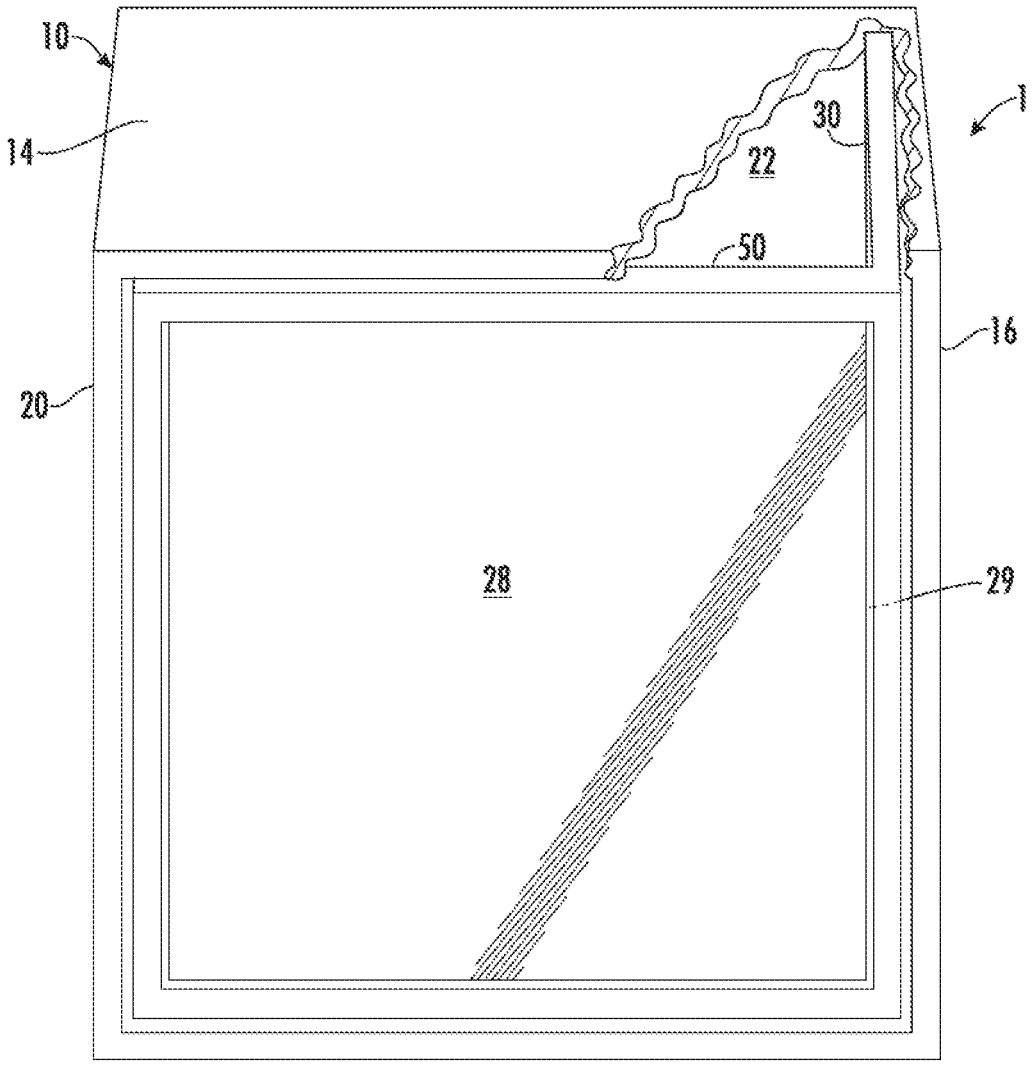
FIG. 4 is a front perspective view of the cabinet assembly of FIG. 3 in a closed position with a portion cut away.

An upper pivot assembly 8 and an optional lower pivot assembly 9 connect the NRIM 2 to the cabinet 10 and allow the NRIM 2 to rotate between an open position (shown in FIGS. 1-3), an intermediate position (FIG. 5), and a closed position (FIG. 4). Other intermediate positions are also attainable. The first front-surface mirror 30 and the second front-surface mirror 50 are fixedly connected so as to pivot in unison and continuously provide the non-reversed viewing plane or image. In the closed position of FIG. 4, both the first front-surface mirror 30 and second front-surface mirror 50 are disposed completely within the cabinet 10 so as to not be viewable.

As shown in FIGS. 1-4, the cabinet 10 includes a front opening 12, top wall 14, right side wall 16, bottom wall 18, left side wall 20, and back wall 22. The cabinet 10 defines an inner depth 24 (inside the back wall 22) and an outer width 23. As further discussed below, the top wall 14 includes a socket 26 comprising part of the upper pivot assembly 8 and the bottom wall 18 includes a socket 27 comprising part of the lower pivot assembly 9.

As shown in FIG. 4, a flat mirror 28 (that is, a typical single-panel reversing image mirror) is mounted to a back side 29 of the second front-surface mirror 50, so as to be visible in the closed position. The back side 29 of the second front-surface mirror substantially covers the front opening 12 in the closed position. Accordingly, the flat mirror 28 may be mounted opposite the second front-surface mirror 50, on the back side 29.

Figure 7:
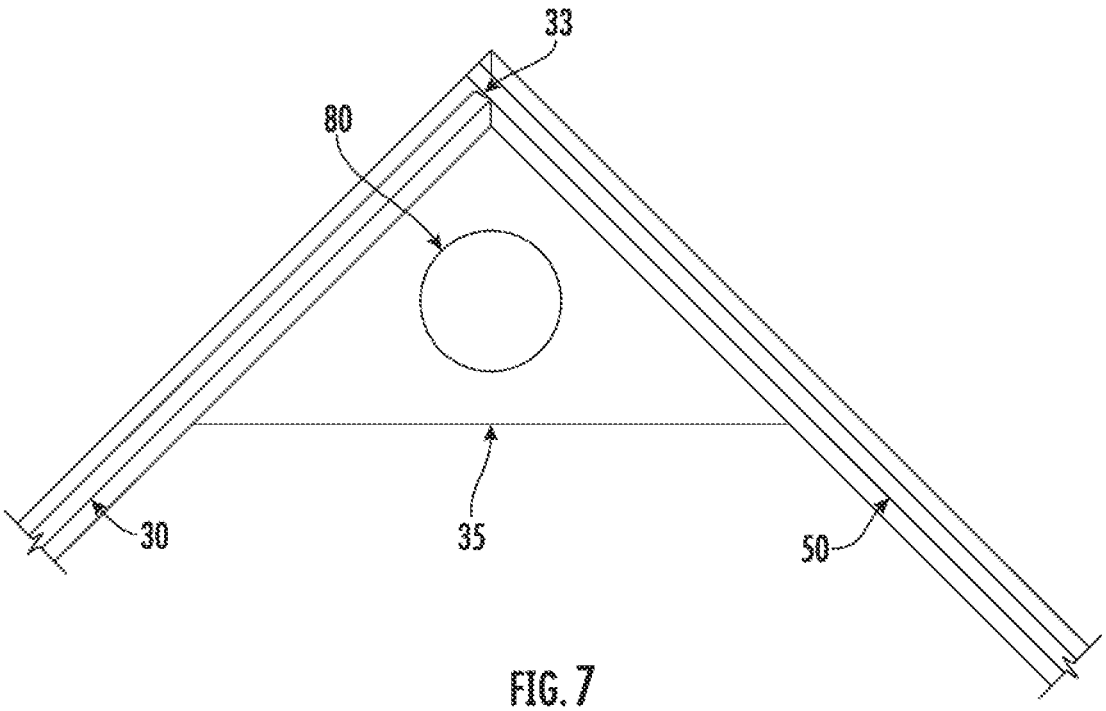
FIG. 7 is a partial top plan view of a cabinet assembly according to yet another embodiment of the present invention.

Returning to FIGS. 1-4, the first front-surface mirror 30 includes a top 32, right side 34 coextensive with the intersection 6, bottom side 36, and left side 38. The first front-surface mirror 30 defines a width 40. The right side 34 may be an edge that is beveled, or back beveled as shown in FIG. 7 and discussed further below, for example by grinding and polishing, to allow a close manufacturing tolerance at the intersection 6.

The second front-surface mirror 50 includes a top 52, right side 54, bottom side 56, and a left side 58 coextensive with the intersection 6. The second front-surface mirror 50 defines a width 60. The width 60 may be approximately twice the width 40 of the first front-surface mirror 30. In some embodiments, the width 60 may be about 12 inches. The width 60 is less than the width 23 of the cabinet 10, so as to fit between the cabinet sidewalls 16, 20. As shown in FIGS. 1-3, in the open position, the second front-surface mirror 50 extends forward through the opening 12 and beyond the cabinet 10.

As shown in FIGS. 1-3, the upper pivot assembly 8 includes complementary components mounted to the second front-surface mirror 50 and the cabinet 10. In the illustrated embodiment of the upper pivot assembly 8, a pivot pin 62 is mounted to the second front-surface mirror 50 for rotation in a socket 26 formed in the top wall 14 of the cabinet 10. As noted above, the lower pivot assembly 9 is optional. The NRIM 2 may be mounted in the cabinet 10 solely by the upper pivot assembly 8. In other embodiments, the upper pivot assembly 8 may be excluded and the NRIM 2 may be mounted in the cabinet 10 solely by the lower pivot assembly 9.

The lower pivot assembly 9 may be constructed from a similar arrangement of components as the upper pivot assembly 8, such as a pivot pin 64 on the second front-surface mirror 50 and a socket 27 formed in the bottom wall 18 of the cabinet 10. The upper pivot assembly 8 and the lower pivot assembly 9 are offset from a midpoint 25 of the width 23 of the opening 12. Because the intersection 6 in the open position is located generally or substantially at the midpoint 25 of the width 23 of the opening 12, the upper and lower pivot assemblies 8, 9 are also offset in the widthwise direction from the intersection 6. In other words, the upper and lower pivot assemblies 9 are not equidistant between the side walls 16, 20 of the cabinet 10.

FIG. 2 specifies the relative dimensions and geometry of the preferred embodiment. Of particular note, the first front-surface mirror 30 is positioned to extend substantially forward beyond the front opening 12 of the cabinet 10, and the pivot 8, 9 is located at or near the front opening 12. The pivot 8, 9 is offset from the midpoint 25 of the width 23 of the cabinet by a distance X.

FIG. 3 shows the relative dimensions and geometry of an alternative embodiment of the present disclosure. As shown in FIG. 3, in the open position, the first front-surface mirror 30 is positioned substantially within the cabinet 10 and does not extend substantially forward beyond the front opening 12. In this embodiment, the width 40 may be, for example, about 5 to about 6 inches. Various other joint structures can be used as the upper pivot assembly 8, such as a ball-and-socket or a hinge joint. Therefore the pivot pins 62, 64 or other substitute joint structures constitute pivots attached to the second front-surface mirror 50. Likewise the sockets 26, 27 or other substitute joint structures constitute pivot counterparts attached respectively to the top wall 14 and bottom wall 18 of the cabinet 10. The upper pivot assembly 8 and/or the lower pivot assembly 9 may allow manual removal of the NRIM 2, for example by providing a retraction mechanism for the pivot pins 62 and/or 64.

The upper and lower pivot assemblies 8, 9 are arranged to position the intersection 6 of the NRIM 2 generally or substantially at the midpoint 25 of the width 23 of the cabinet 10 when in the open position. By this arrangement, a projected non-reversed image of the NRIM 2 appears to fit in the cabinet 10 as it would for a typical flat mirror; in other words, the projected non-reversed image appears similar to a reflection in flat mirror 28 when in the closed position of FIG. 4. In the closed position, the upper and lower pivot assemblies 8, 9 are arranged to position the intersection 6 of the NRIM 2 proximate to the side wall 16 and the front opening 12 of the cabinet 10.

As mentioned above, first surface mirrors are particularly delicate and therefore features may be added to provide additional protection to the first and second front surface mirrors 30, 50. For example, dampening mechanisms may be built into the pivot 8, 9 or into the cabinet 10 to engage the NRIM 2 as it approaches each of the open and closed positions. A dashpot, gas spring, coil spring, damper, or the like may be employed for this purpose.

As shown in FIG. 1, the first front-surface mirror 30 may be mounted in a frame 31 and the second front-surface mirror 50 may be mounted in a frame 51. These frames 31, 51 extend around the three outer sides of their respective front-surface mirror 30, 50 with one side open for the intersection 6. At least one of the first and second front-surface mirrors 30, 50 may include an adjustment mechanism 42 for adjustment of an angle of the mirror within the frame 31 and/or 51. Such adjustment may be necessary, for example, after shipment of the device. The adjustment may include rotation about a horizontal axis and/or rotation about a vertical axis. The horizontal and/or vertical axis of adjustment may be located at a midpoint of the width 40, 60 and/or height of the respective front-surface mirror 30, 50.

Figure 5:
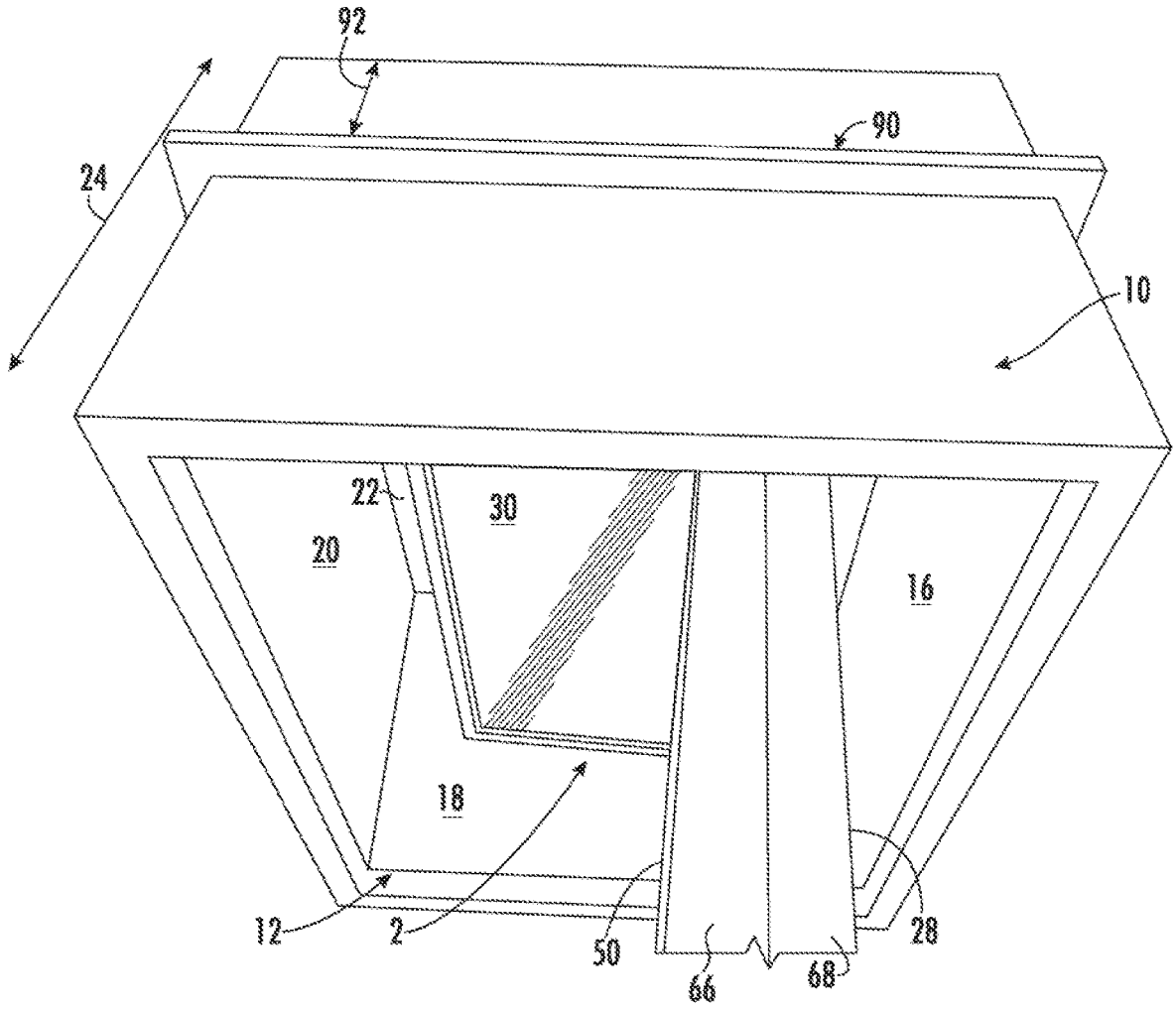
FIG. 5 is a front perspective view of the cabinet assembly of FIG. 3 in an intermediate position.

Turning to FIG. 5, an intermediate position of the NRIM is shown. The NRIM 2 is still visible and usable, particularly when the viewer is standing toward the left sidewall 20 of the cabinet 10. The flat mirror 28 is also visible and usable for a user positioned toward the right sidewall 16 of the cabinet 10. The intermediate position may allow multiple people to separately use the NRIM 2 and the flat mirror 8 and also may allow access to the interior of the cabinet 10 for storage and cleaning purposes.

As further shown in FIG. 5, the second front-surface mirror 50 may be mounted to a first panel 66 and the flat mirror 28 may be mounted to a second panel 68, the first and second panels 66, 68 being coextensive and joined together. The panels 66, 68 may be removably attached, allowing for variations in appearance and/or attachments while allowing easy repair and disassembly.

In lieu of the flat mirror 28, the second panel 66 or 68 may mount other decorative features such as artwork or an advertisement. A flat screen television (preferably LED) may be mounted in lieu of the flat mirror 28, which is especially useful in commercial applications.

In some embodiments such as shown in FIG. 2, less than half of the width 40 of the first front-surface mirror 30 extends beyond the front opening 12, while more than half of the width 60 of the second front-surface mirror 50 extends beyond the front opening 12. In the open position, the widthwise distance that the second front-surface mirror 50 extends beyond the front opening 12 may be greater than the widthwise distance that the second front-surface mirror extends by X, 2X, or more than 2X.

This distance X also defines the distance that the intersection 6 is recessed back from the front opening 12 of the cabinet 10. In the preferred embodiment shown in FIGS. 1 and 2, the distance from the pivot 8, 9 outward to the right side 16 of the cabinet 10 is $X*\sqrt{2}$. The distance that each of the front-surface mirrors 30, 50 extends from the intersection 6 to the front opening 12 is also $X*\sqrt{2}$ in the open position.

As shown in FIGS. 1 and 2, because the width 60 of the second front-surface mirror 50 is only slightly smaller than the width 23 of the cabinet 10, the width 60 is substantially equal to $2*(X+X*\sqrt{2})$, simplified as $2*X*(1+\sqrt{2})$ and further simplified as $4.83*X$. Accordingly, the portion of the second front-surface mirror 50 that extends beyond the front opening 12 has a width 61 of $3.41*X$. If the width 40 of the first front-surface mirror 30 is substantially half the width 60 of the second front-surface mirror 50, then the widthwise distance of the first front-surface mirror 30 extends beyond the front opening 12 is substantially X.

Figure 6:
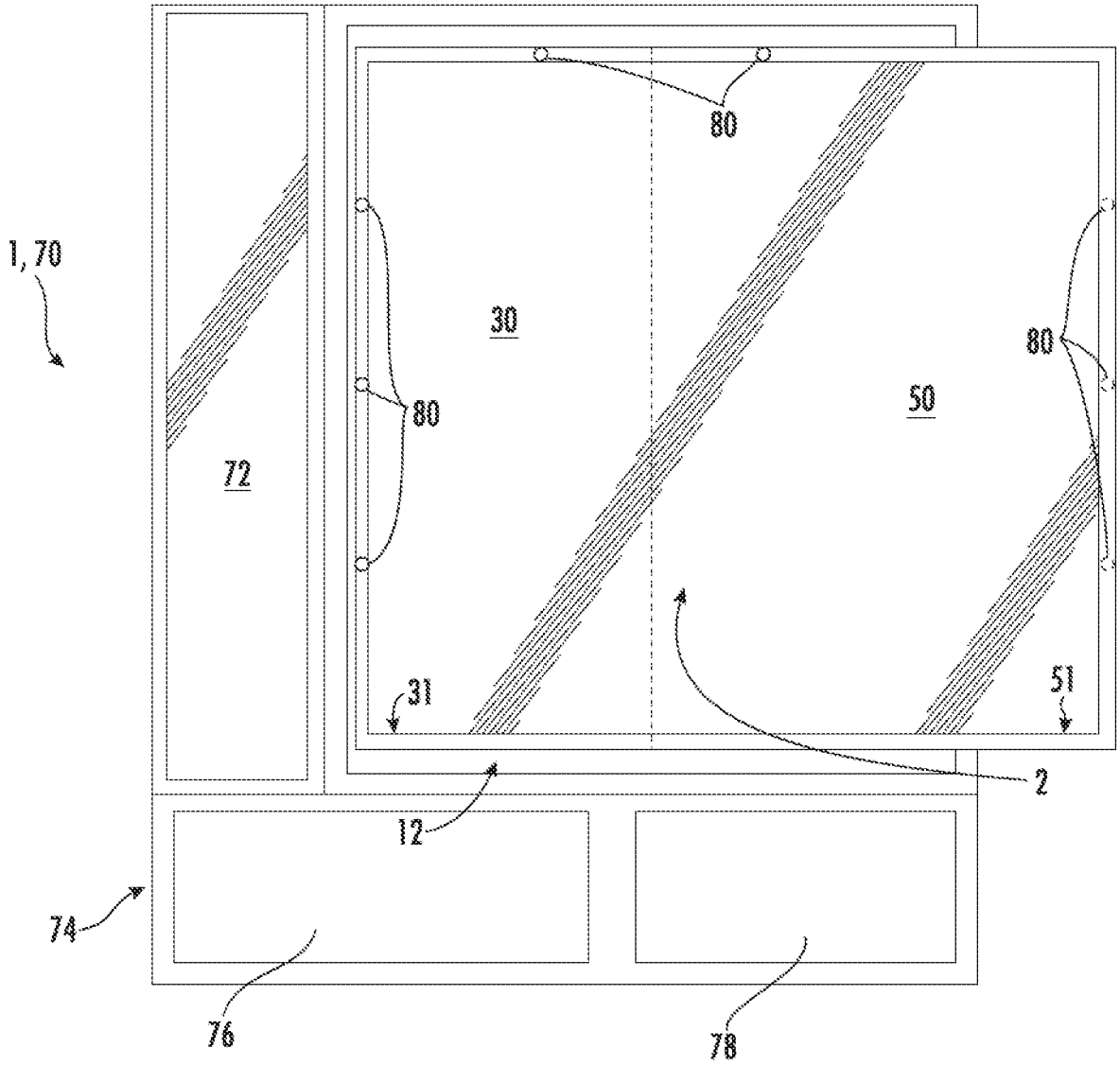
FIG. 6 is a front elevation view of an alternative cabinet assembly.

FIG. 6 illustrates an alternative cabinet 70. A portion of the cabinet 70 is substantially similar to the cabinet 10, having a front opening 12 and pivotably supporting the NRIM 2. The cabinet 70 may also include various additional features, including storage features, positioned outside and/or adjacent to the front opening 12. As illustrated, a flat mirror 72 is positioned next to the NRIM 2. A lower cabinet 74 having pair of open storage shelf compartments 76, 78 is positioned below the NRIM 2. The flat mirror 72 may be mounted to a door openable to a storage cabinet, for example a medicine cabinet. Various additional doors, drawers, shelves, and the like may be incorporated with cabinet 70.

The NRIM 2 and cabinet 10, 70 may be provided with lighting fixtures 80 to aid viewing. As shown in FIG. 1, lighting fixtures 80 may be incorporated in an underside of the top side 14 of the cabinet 10, to shine down on the NRIM 2. As shown in FIG. 6, lighting fixtures 80 may be incorporated within one or more sides of the frames 31, 51. LED lighting has a small form factor to fit within the frames 31, 51.

One skilled in the art should recognize that the depth 24 of the cabinet 10 is generally equal to the width 40 of the first front-surface mirror 30 and likewise the width 23 of the front opening 12 of the cabinet 10 is generally equal to the width 60 of the second front-surface mirror 50, while allowing clearance to pivot as shown in FIGS. 1-4. At the same time, because the upper and lower pivot assemblies 8, 9 are offset in a widthwise direction and the second NRIM 50 is wider than the first NRIM, the present disclosure provides an elegant, streamlined, and sturdy cabinet in both the closed and open positions while also maximizing the non-reversed viewing plane.

FIG. 7 illustrates features that may be applicable to the cabinet 10 or the cabinet 70. The first front-surface mirror 30 is provided with a back bevel 33 where the intersection 6 forms a T-shape. One skilled in the art would appreciate that a back bevel may be provided on either the first or second front-surface mirror 30, 50, depending on which terminates in the middle of the T-shape. The back bevel 33 provides for improved assembly of the NRIM 2 with a tighter fit between the first and second front-surface mirrors 30, 50.

Also shown in FIG. 7 is a gusset 35, which may be mounted to the top sides 32, 52 and/or the bottom sides 36, 56 of the first and second front-surface mirrors 30, 50. The gusset 35 is triangular shaped and provides structural support to the NRIM 2 and maintains the angle 4 between the first and second front-surface mirrors 30, 50. The gusset 35 may be an isosceles triangular sized to not be visible when the NRIM 2 is in the open position; in other words, the gusset 35 does not extend beyond the cabinet 10 or 70. The gusset 35 may support one or more of the light fixtures 80 discussed above.

The NRIM 2 of the present disclosure provides several factors of convenience. Because the first and second front-surface mirrors 30, 50 extend forward from the cabinet, there is minimal obstruction directly above and below the mirrors, which allows a user to easily hold their face close up to the mirror. Moreover, the first and second front-surface mirrors 30, 50 (and especially the second front-surface mirror) are large enough that a user can simply turn directly toward a selected mirror and use it in the same manner as a typical reversed-image mirror. The cabinet 10 of the present disclosure may be installed upside-down to allow rotation/operation in reverse (that is, if the disclosed embodiments are installed upside-down, the second front-surface mirror 50 can be pulled/rotated forward by being grasped at the right side of the cabinet).

In alternative embodiments, the widths 40, 60 of the first and second front-surface mirrors 30, 50 may be substantially equal. The depth 24 of the first and second front-surface mirrors 30, 50 may be substantially equal to the width, resulting in a cabinet 10 that is cuboid. Such symmetrical alternatives may be desirable in portable "table-top" versions of the cabinet 10.

The second front-surface mirror 50 and the flat mirror 28 may be designed so as to minimize their thickness. The second front-surface mirror 50 and the flat mirror 28 may be provided as a single mirror panel without an intervening panel. If a panel is used, the back side 29 of the panel may be directly coated with the reflective material used in forming the flat second-surface mirror 28.

As shown in FIG. 5, a collar 90 may be provided that circumscribes the top wall, sidewalls, and bottom wall 14, 16, 18, 20. The collar functions as a mounting flange and/or joint cover for permanently connecting the cabinet 10 to a wall or other pre-existing structure. The collar 90 may be located anywhere along the depth 24 of the cabinet 10, and in some embodiments may be located at a distance 92 from the back wall 22 of about 4 inches, which is a typical depth for a medicine cabinet. In other embodiments, the collar 90 may be flush with the front of the cabinet 10 to allow for a fully-recessed installation.

Having thus described the presently preferred embodiments in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiments are possible which do not alter, with respect to those parts, the inventive concepts and principles embodied therein. For example, the walls 14-20 of the cabinet 10 could be omitted and the NRIM 2 (including first front-surface mirror 30, second front surface mirror 50, and pivot assemblies 8, 9) could be installed in a cavity of a building wall or as part of a vanity unit. The cabinet 10 could also be installed directly on a wall surface. Likewise the cabinet 10 could be a freestanding unit, and sized for portability. The present embodiments and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A mirror cabinet, comprising: A non-reversing image mirror pivotably disposed within a cabinet; the non-reversing image mirror comprising: a first front-surface mirror connected to a second front-surface mirror, the second front-surface mirror disposed at an angle of about 90 degrees to the first front-surface mirror to create a non-reversing image viewing plane, and a pivot attached to the second front-surface mirror between a first side wall and a second side wall of the second front-surface mirror, and the second front-surface mirror having a width greater than a width of the first front-surface mirror; and the cabinet comprising: a front opening, and a pivot counterpart; wherein the pivot is connected to the pivot counterpart such that the non-reversing image mirror is pivotable between a closed position and an open position; wherein a back side of the second front-surface mirror substantially covers the front opening in the closed position; and wherein the non-reversing image viewing plane is visible through the front opening in the open position.

2. The mirror cabinet of claim 1, wherein the pivot is attached to the second front-surface mirror at a pivot point which is not equidistant from the second side wall and the first side wall.

3. The mirror cabinet of claim 1, wherein the first front-surface mirror is connected to a second front-surface mirror at an intersection, and wherein the intersection and the pivot are offset by a predetermined distance from a midpoint of a width of the cabinet.

4. The mirror cabinet of claim 1, wherein in the open position, the first front-surface mirror is positioned substantially within the cabinet and the second front-surface mirror extends beyond the front opening.

5. The mirror cabinet of claim 1, wherein the width of the second front-surface mirror is approximately twice the width of the first front-surface mirror.

6. The mirror cabinet of claim 1, wherein the first front-surface mirror and the second front-surface mirror are fixedly connected so as to pivot in unison.

7. The mirror cabinet of claim 1, wherein the first front-surface mirror is connected to a second front-surface mirror at a T-shape intersection.

8. The mirror cabinet of claim 1, wherein, in the closed position, both the first front-surface mirror and second front-surface mirror are disposed completely within the cabinet.

9. The mirror cabinet of claim 1, further comprising a flat mirror mounted opposite the second front-surface mirror for use when the non-reversing image mirror is in the closed position.

10. The mirror cabinet of claim 9, wherein the non-reversing image mirror is pivotable to an intermediate position whereat the non-reversing image mirror and the flat mirror may be separately used.

11. The mirror cabinet of claim 9, further comprising a back panel mounted opposite the second front-surface mirror for use when the non-reversing image mirror is in the closed position, the back panel mounting a decorative feature or display monitor.

12. The mirror cabinet of claim 1, wherein the cabinet further comprises a plurality of compartments adjacent to the front opening.

13. A method of viewing a non-reversing image mirror, comprising: providing a cabinet including a front opening, a first side wall, a second side wall, and a pivot counterpart; providing a non-reversing image mirror pivotably disposed within the cabinet, the non-reversing image mirror including: a first front-surface mirror connected to a second front-surface mirror at an intersection, the second front-surface mirror disposed at an angle of about 90 degrees to the first front-surface mirror to create a non-reversing image viewing plane, a pivot attached to the second front-surface mirror between a first side wall and a second side wall of the second front-surface mirror, wherein the pivot and pivot counterpart are not equidistant between the first and second side walls of the cabinet, and the second front-surface mirror having a width greater than a width of the first front-surface mirror; rotating the non-reversing image mirror via the pivot and pivot counterpart from a closed position to an open position, wherein the non-reversing image viewing plane is visible through the front opening in the open position; and positioning the intersection at about a midpoint of a width of the cabinet between the first and second side walls of the cabinet.

14. The method of claim 13, wherein in the open position, the first front-surface mirror is positioned substantially within the cabinet and the second front-surface mirror extends beyond the front opening.

15. The method of claim 13, wherein the width of the second front-surface mirror is approximately twice the width of the first front-surface mirror.

16. The method of claim 13, wherein the first front-surface mirror and the second front-surface mirror are fixedly connected so as to pivot in unison.

17. The method of claim 13, wherein, in the closed position, the second front-surface mirror is disposed at an angle of about 90 degrees to the first front-surface mirror.

18. The method of claim 13, wherein, in the closed position, both the first front-surface mirror and second front-surface mirror are disposed completely within the cabinet.

19. The method of claim 13, further comprising providing a flat mirror opposite the second front-surface mirror for use when the non-reversing image mirror is in the closed position.

20. The method of claim 13, wherein the cabinet further comprises a plurality of storage features adjacent to the front opening.

21. The method of claim 13, wherein a back side of the second front-surface mirror substantially covers the front opening in the closed position.

* * * * *